US005100251A

United States Patent [19]

Yasuoka

[11] Patent Number: 5,100,251

[45] Date of Patent: Mar. 31, 1992

[54] PAPER TRACTOR MECHANISM

[75] Inventor: Tadashi Yasuoka, Tokyo, Japan

[73] Assignee: Seikosha Co., Ltd., Japan

[21] Appl. No.: 162,890

[22] Filed: Mar. 2, 1988

[30] Foreign Application Priority Data

Mar. 2, 1987 [JP] Japan ..... 62-47060

[51] Int. Cl.[5] ..... B41J 15/22

[52] U.S. Cl. ..... 400/616.1; 400/616; 400/605

[58] Field of Search ..... 400/616, 616.1, 605, 400/608.1, 607.2, 551

[56] References Cited

U.S. PATENT DOCUMENTS

| | | | |
|---|---|---|---|
| 4,160,606 | 7/1979 | Caenazzo | 400/616.2 |
| 4,413,764 | 11/1983 | Weber et al. | 226/74 |
| 4,475,833 | 10/1984 | Sawicki | 400/605 |
| 4,564,305 | 1/1986 | Rekewitz et al. | 400/605 |
| 4,571,103 | 2/1986 | Takeo et al. | 400/616.1 |
| 4,579,471 | 4/1986 | Hendrischk | 400/605 |
| 4,663,722 | 5/1987 | Sato | 400/605 |
| 4,688,957 | 8/1987 | Prevignano | 400/605 |
| 4,742,946 | 5/1988 | Hamamichi et al. | 226/74 |

FOREIGN PATENT DOCUMENTS

| | | | |
|---|---|---|---|
| 191984 | 8/1986 | European Pat. Off. | 400/605 |
| 18281 | 1/1982 | Japan | 400/605 |
| 161175 | 8/1985 | Japan | 400/616.2 |
| 172567 | 9/1985 | Japan | 400/616.2 |
| 63464 | 4/1986 | Japan | 400/551 |
| 233275 | 10/1987 | Japan | 400/616.3 |

*Primary Examiner*—Edgar S. Burr
*Assistant Examiner*—John S. Hilten
*Attorney, Agent, or Firm*—Bruce L. Adams; Van C. Wilks

[57] ABSTRACT

A paper tractor unit is disclosed. The tractor unit which is movably provided for a support member can be selectively moved between a position at which a continuous paper is fed and a position from which the paper is drawn, a paper drawing drive roller and a pinch roller being provided at the position from which the paper is drawn. A release lever is provided which moves in synchronization with a switching position to the position from which the paper is drawn. A pinch roller and a guide shaft are provided for a support plate which is capable of being moved by the release lever. The pinch roller can come into contact with the paper-drawing drive roller and move away from the same. The guide shaft can freely move along a guide portion in a direction in which the pinch roller comes into contact with and moves away from the drive lever. A guide pin is a pinion and a rack is formed on the guide portion for the purpose of engaging with the pinion.

7 Claims, 5 Drawing Sheets 1
2
2a
3
4
4a
5
6
7
8
10
11
12a
12b
12c
12d
12e
13
16
17
18
19
19a
20
21
22
23
24
25
26
A
B
C
D
E
F
T

PAPER TRACTOR MECHANISM

BACKGROUND OF THE INVENTION

This invention relates to a paper tractor mechanism of a printing device for use for printing a continuous paper sheet.

There are generally two types of recording paper sheets which are printed by a printing device, namely, a continuous paper sheet and cut sheets which are selectively used. The cut sheets are drawn by means of a drawing drive roller and a pinch roller, while a paper tractor is used when the continuous paper is printed.

Furthermore, since a variety of sizes of recording paper sheets is needed, paper feeding ports which correspond to the sizes of the recording paper sheets are provided.

Therefore, a driving roller and a pinch roller are provided at the drawing position for the cut sheet, while the continuous paper printing needs a paper tractor. Therefore, if drawing ports which correspond to the types of the recording sheets consisting of the cut sheets and the continuous sheet are separately provided in a printing device, the size of the whole printing device becomes too large. Furthermore, if one paper drawing port for both the cut sheets and the continuous paper is employed, the size of the device can be reduced. However, if a convenient mechanism, for example, a page arrangement mechanism, is intended to be provided at the drawing position, the presence of the paper tractor for drawing the continuous paper obstructs the provision, causing various problems when designing the device.

SUMMARY OF THE INVENTION

An object of the present invention is, therefore, to provide a paper tractor mechanism in which one place is used as a drawing port for both the cut sheet and the continuous paper sheet, and a tractor unit for the continuous paper is arranged to be capable of being used for both feeding the continuous paper sheet and drawing the paper. Furthermore, a special mechanism such as paper arrangement mechanism and so forth can be easily provided, and interchange between the continuous paper and cut sheets can be quickly conducted.

A basic characteristic of the present invention is that a tractor unit is rotatably provided for a support member, and this tractor unit can be selectively shifted between a position from which a recording sheet is fed and a position from which the same is drawn.

A further characteristic of this invention is that a release lever is further provided which is arranged to move in shynchronization with a shifting movement of the tractor unit between a position from which a paper is fed and a position from which the paper is drawn, and a support plate which is capable of being moved by means of this release lever is provided with a pinch lever and a guide shaft, whereby when the guide shaft is moved in a guide portion, the pinch roller comes into contact with a driving roller for drawing the recording paper and moving away from the same.

By such a construction, when the cut sheet is printed, the tractor unit is positioned where the continuous paper is fed, while the cut sheet is drawn by means of the drive roller and a pinch roller for drawing the paper.

Meanwhile, when the continuous paper is printed, two paper feeding methods can be selected. In a case where the tracter unit is shifted at a selected continuous paper feeding port, the continous paper is fed by means of this tractor unit, and is drawn by means of the drive roller and the pinch roller.

In a case where no tractor unit is provided at another selected continuous paper feeding port, the tractor unit is rotated so that the same is moved away from the paper feeding position to the paper drawing position, and then the continuous paper is set to this unit so that the paper is drawn.

In this state, the release lever is operated by means of the rotation of the tractor unit, whereby the support plate on which the pinch roller is provided is moved along the guide portion. As a result of this, the pinch roller is moved away from the drive roller for drawing the paper. Therefore, continuous paper can be smoothly set to the tractor unit which is disposed at the paper drawing port, whereby the continuous paper is drawn by means of the tractor unit.

When the printing of the continuous paper is changed to the printing of the cut sheets, the tractor unit is rotated so as to be moved from the position where the paper is drawn to the position through which the paper is fed, as a result of this movement, the release lever restores its original position due to this rotation, and as a result of this, the pinch roller again abuts against the drive roller, whereby the cut sheet is drawn.

BRIEF DESCRIPTION OF THE DRAWINGS

The accompanying drawing illustrate an embodiment of the present invention, wherein.

DETAILED DESCRIPTION OF INVENTION

Referring to the accompanying drawings, an embodiment of the present invention will now be described.

Figure 1:
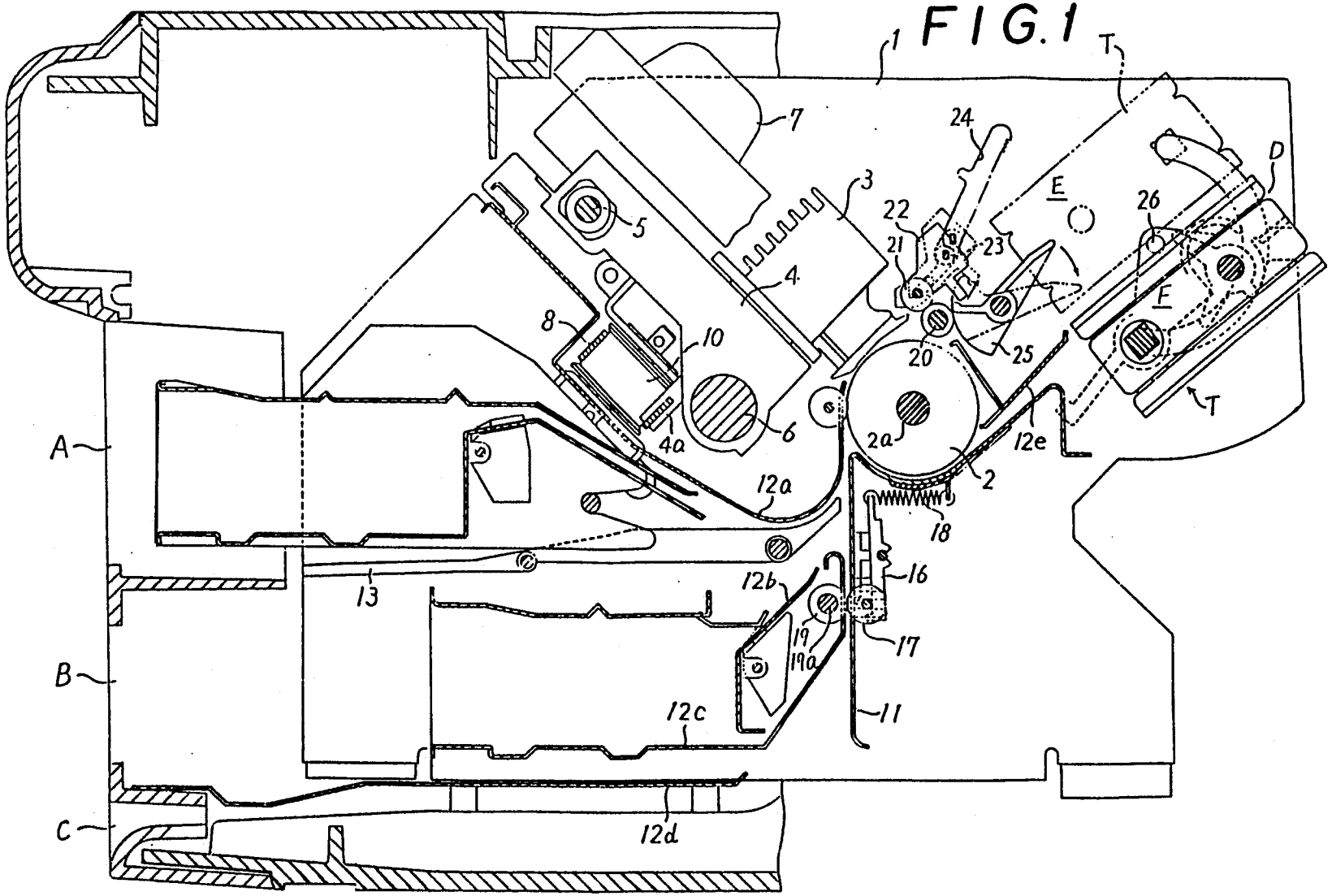
FIG. 1 is a cross-sectional view of a printing device embodying the present invention.

Referring to FIG. 1, a platen 2 is rotatably provided relative to a shaft **2*a* thereof between side plates 1 and 1A (see FIG. 6) which form a frame of the printing device and oppose each other. The position at which the platen opposes the side plates is provided with a printing head 3. The printing head 3 is mounted on a carriage 4 which can be horizontally reciprocated along two guide shafts 5 and 6. A ribbon cassette 7 is provided behind the printing head 3. Means for driving the carriage 4 is, as known, constituted by a securing member 4*a* which is integrally and projectingly formed from this carriage, and which is connected to an endless belt 8 which is driven by a drive pulley 10 which is rotated by a carriage motor 9 (see FIG. 6**).

The recording paper is introduced into a space formed between the platen 2 and the printing head 3, the space defining a printing position or region at which the recording paper is printed.

A paper feeding port from which the recording paper is supplied to the printing position and a guide passage for introducting the recording paper to the printing position will now be described.

The cut sheet feeding ports are disposed in the front surface of the outer case (lefthand side of FIG. 1) of the printing device in such a manner that they form two vertical stages consisting of A and B. A cartridge (omitted from the illustration) which accommodates the cut sheets is insertable in the paper feeding ports, whereby the cut sheets are supplied.

On the other hand, in a case where the continuous paper is fed, two paper feeding ports consisting of a paper feeding port C disposed beneath the paper feeding port B for the cut sheet and a paper feeding port D disposed in the upper portion of the backside (righthand of FIG. 1) are used.

The two paper feeding ports are respectively provided for the cut sheets and the continuous sheet for the purpose of facilitating changing of the size of the recording paper sheets.

The structure of the guide for introducing the recording paper from the paper feeding ports A, B and C will now be described. A guide passage is formed by a support plate 11 and guide plates 12*a*, 12*b*, 12*c* and 12*d*. Another guide passage is formed starting from the paper feeding port D by a guide plate 12*e* which is disposed at a certain distance from the support plate 11.

When the cut sheets are fed by hand, the paper feeding port A can be used and a guide member 13 is arranged to be used.

Figure 2:
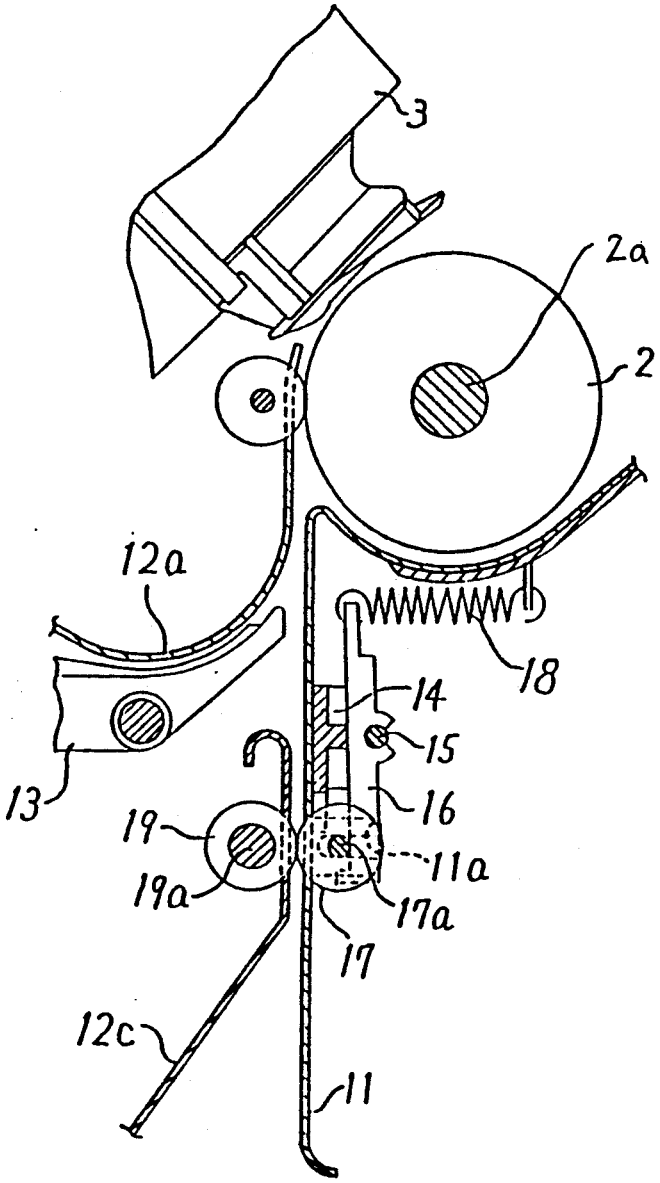
FIG. 2 is an enlarged cross-sectional view of a paper feeding means.

The structure of driving means for feeding the continuous paper is disposed in the upper stream of the platen 2 and will now be described with reference to FIG. 1 and FIG. 2 which is an enlarged view of an essential portion.

On the backside of the support plate 11 is provided a projecting mounting plate 14 to which a shaft 15 is secured, a lever 16 being movably provided for this shaft. A shaft bearing groove 11*a* is integrally formed with the support plate 11. A shaft 17*a* of a pinch roller 17 is movably and rotatably inserted into the shaft bearing groove. The lower end portion of the lever 16 is positioned in elastic contact with the shaft of the pinch roller 17. The spring force for realizing this elastic contact is applied by a spring 18 which is fitted to the top end portion of the lever 16. The pinch roller 17 projects over a hole in the support plate 11 into the guide passage, and is then positioned in elastic contact with a drive roller 19 for feeding paper. The drive roller is journaled to a drive shaft 19*a*, whereby the same is driven.

A drawing mechanism for drawing the cut sheets (or sometimes for the continuous paper) at a position E from which the recording sheet is drawn in the lower stream of the platen 2 will now be described with reference to FIG. 1 and FIG. 3 which is an enlarged view of an essential portion.

A drive roller 20 for drawing the paper is rotated by means of its shaft 20*a*. A pinch roller 21 is positioned in elastic contact with the drive roller to define an enabled state, whereby the printed recording paper is drawn by way of association of the two rollers, the pinch roller being arranged to be able to be brought into and out of contact with the drive roller to define a disenabled state. That is, the pinch roller 21 forms one unit in which a rotational shaft 21*a* of the roller is supported by a support plate 22 to which a guide shaft, for example, a shaft of a pinion 23 is rotatably fitted, the pinion being disposed in a guide hole 24 which is bored in the side plate. At one inner end of the guide hole 24 is provided with a rack 24*a* with which the pinion 23 is engaged. Therefore, when the pinion 23 is brought into engagement with the rack 24*a* it is moved upwardly in the guide hole 24, and the support plate 22 is also moved upwardly. As a result of this, the pinch roller 21 is moved away from the surface of the driving roller 20.

Another pinch roller unit whose structure is described above is also provided for the other side plate at the corresponding position. The rack 24*a* is formed in the guide hole 24 so that the horizontal movements of the pinion 23 are made uniform. A recess 24*b* is formed in the inner surface of the guide hole 24 at the position opposite to the rack 24*a* for the purpose of facilitating manual raising of the support plate 22 up to the top end of the guide hole 24 and engaging the shaft 21*a* of the pinch roller 21 with the recess so that the ink ribbon is exchanged with this engagement maintained.

The way of moving the pinch roller 21 which is positioned in elastic contact with the drive roller 20 away from the drive roller is realized by displacing a release lever 25 for releasing the pinch roller, the release lever 25 being rotatably fitted to the side plate 1 through a shaft 25*a* into contact with a projection of the support plate 22, and thereby moving the support plate. The movement of the release lever 25 is performed in synchronization with the rotation of the tractor unit T as described hereinafter.

The tractor unit T is disposed at the feeding position F for the purpose of supplying the continuous paper. In this state, the paper supply port D is used for feeding the continuous paper. On the other hand, the tractor unit T can be inverted to the drawing position E for the purpose of drawing the continuous paper. The movement action of the tractor unit T between the paper feeding position F and the paper drawing position E and the structure of the unit will now be described.

A projection 27*a* of a base or support plate 27 (see FIG. 5) on which the tractor unit T is provided is rotatably journaled by a shaft 26 which is provided for the side plate 1. The base plate 27 is provided with a handle 27*b* for inversing the unit T and a through hole through 27*c* which a drive shaft 28 (see FIG. 4) passes and a through hole 27*d* through which a support shaft 29 (see FIG. 4) passes.

Figure 4:
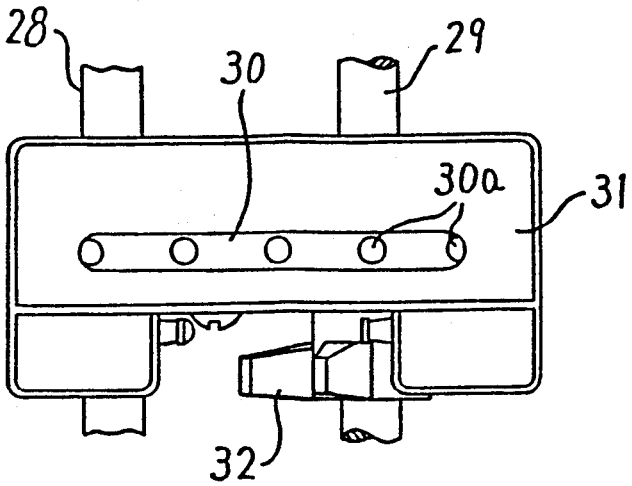
FIG. 4 is a plan view of a tractor unit.
Figure 5:
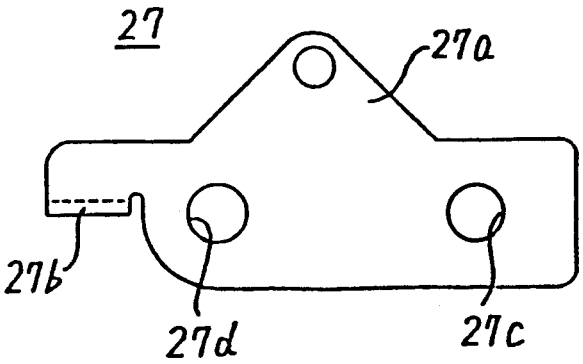
FIG. 5 is a front view of a base plate to which the tractor unit is fitted.

The base plate 27 is stuck to both sides of the tractor unit T shown in FIG. 4. A drive wheel (which is given reference numeral 42 in FIG. 6) and a rotational wheel are rotatably provided in a space formed by the outer frame of the unit. The drive shaft 28 and the support shaft 29 carry the above two wheels. A drive belt 30 is arranged between the rotational wheels. Sprockets 30*a* are projected over the top surface of the belt 30. A cover 31 is provided in such a manner that the same can be freely opened and shut in the state in which the sprockets 30 are exposed. The cover 31 opens when the recording paper is exchanged for the purpose of setting the paper therein. A clip spring is provided for the cover 31. Although the horizontal position of the tractor unit T can be adjusted by way of being moved along the shafts 28 and 29, the unit can be locked at a certain position by a lock lever 32 which is provided for the support shaft 29.

Figure 3:
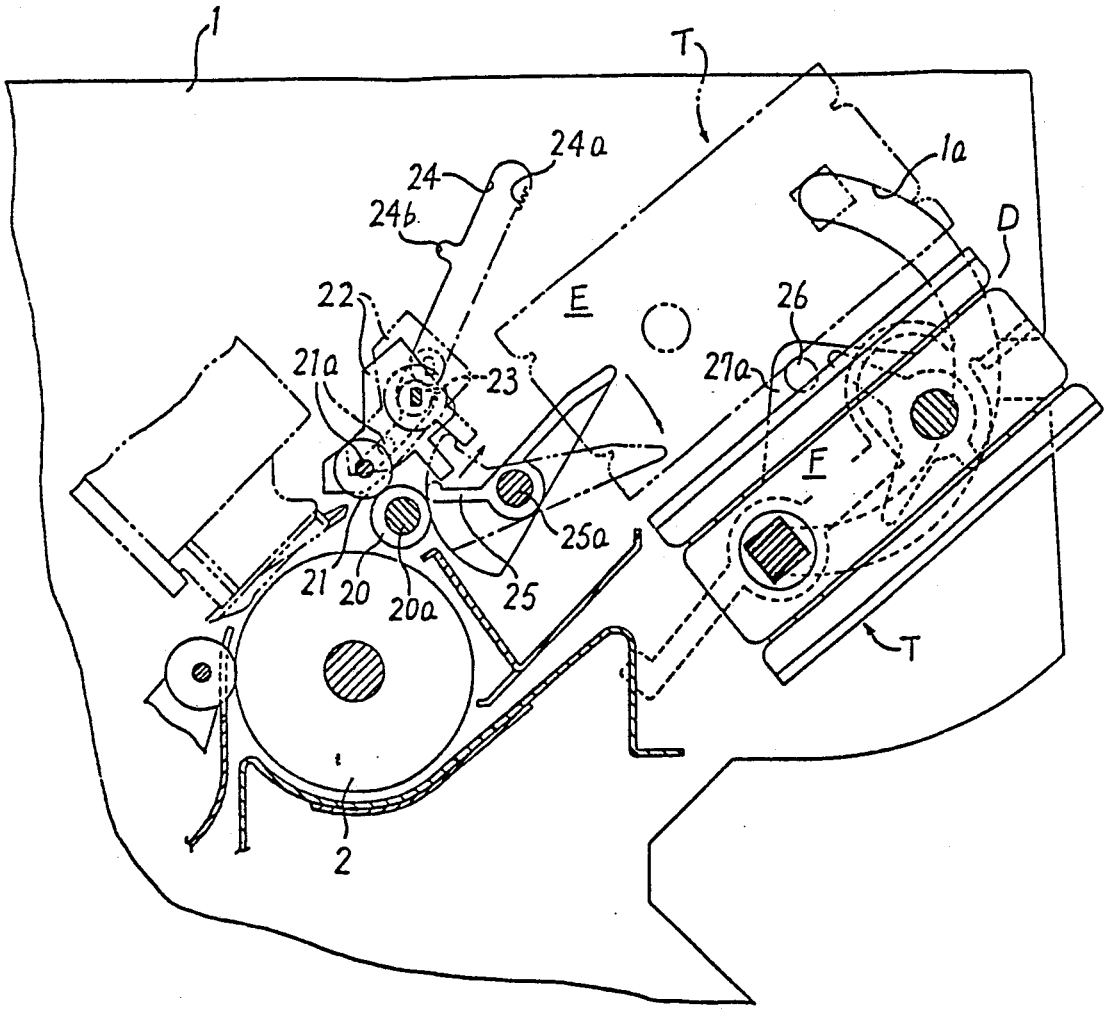
FIG. 3 is an enlarged cross-sectional view of a paper drawing position.

As shown by a continuous line in FIG. 3, the tractor unit T positioned at the feeding position F for the continuous paper is moved within a guide groove 1*a* by way of holding the handle 27*b* of the base plate 27 thereof and rotating the tractor unit T counterclockwise relative to the shaft 26. As a result of this, the tractor unit T can be positioned at the paper drawing position E shown by a long-and short-dash line in FIG. 3.

As a result of this inverse rotation of the tractor unit T, the corner of the base plate 27 clockwise rotates the release lever 25 relative to the shaft 25*a* of the release lever 25. Therefore, the support plate 22 is moved upwardly along the guide hole 24, and thus the elastic contact realized between the pinch roller 21 and the drive roller 20 is released.

Figure 6:
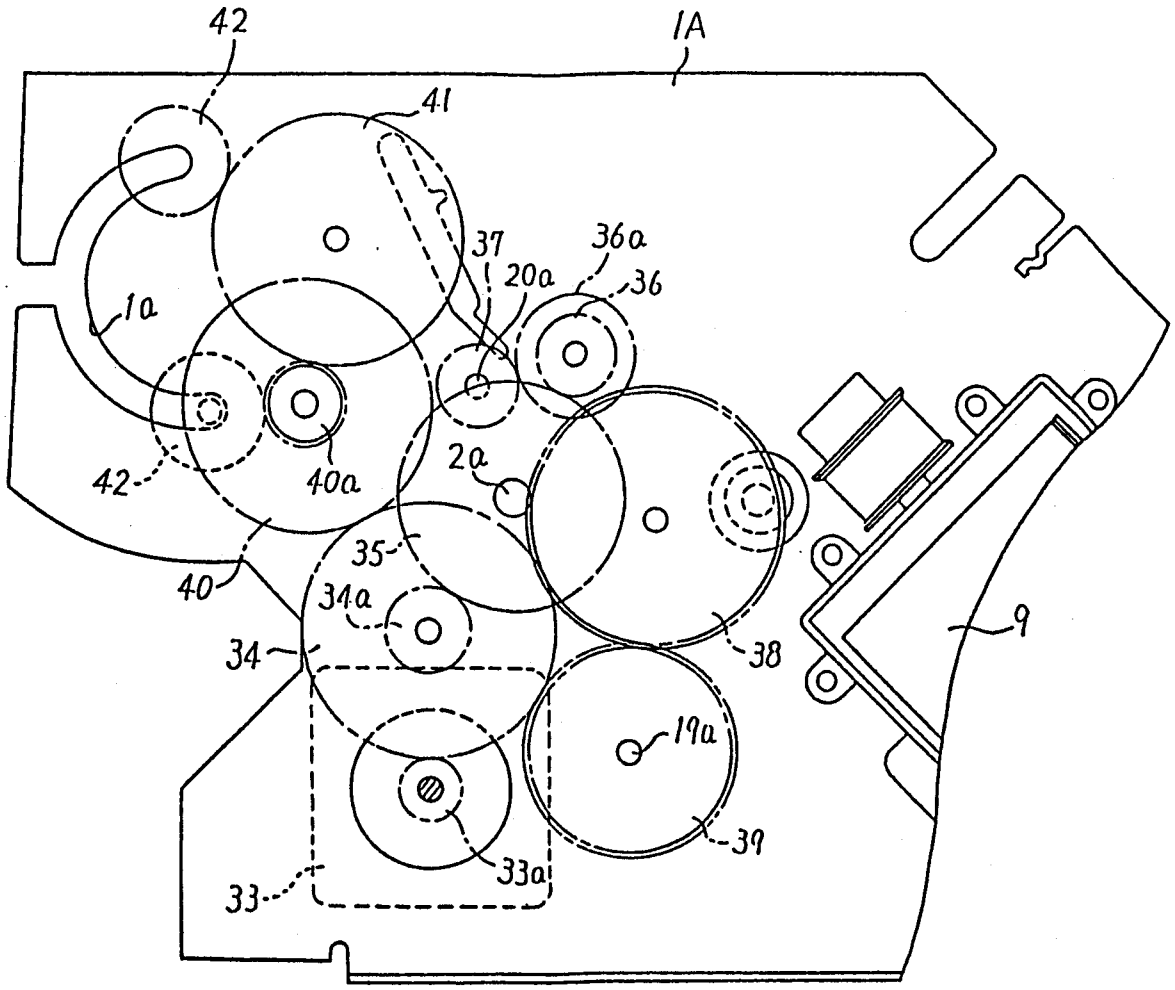
FIG. 6 is a front view of a drive wheel configuration mechanism.

The drive wheel configuration mechanism will now be described with reference to FIG. 6.

A paper feeding motor 33 is disposed in the lower portion of the side plate 1A. A gear 34 is engaged with a pinion 33*a* which is journaled to a drive shaft of the motor. A pinion 34*a* of the gear 34 is positioned in engagement with a drive gear 35 of the platen 2. The drive gear 35 is journaled by the shaft 2*a* of the platen so that the platen is rotated. The drive gear 35 of the platen 2 is positioned in engagement with a pinion 36. A gear 36*a* of the pinion 36 is brought into engagement with a gear 37. The shaft 20*a* of the gear 37 is the same as the shaft 20*a* of the above described paper drawing drive roller 20. The gear 34 is engaged with a gear 38 which in engaged with a gear 39. The shaft 19*a* of the gear 39 serves as a drive shaft of the drive roller 19 for feeding the continuous paper, whereby the continuous paper which has been supplied from the paper feeding port C is introduced to the platen 2.

The gear 34 is engaged with a gear 40, and a pinion 40*a* of the gear 40 is engaged with a gear 41.

The pinion 40*a* can be brought into engagement with a drive gear 42 of the tractor unit T when the tractor unit T is positioned at the paper feeding port D (paper feeding position F). The gear 41 is brought into engagement with the drive gear 42 when the tractor unit T is rotated inversely in the drawing position E.

The operation of the present invention will now be described.

When the continuous paper is supplied through the paper feeding port D, the tractor unit T is positioned at the paper feeding position F whereby the paper is fed by the tractor unit T, and is then printed when the paper passes through between the platen 2 and the printer head 3, and is drawn by means of the paper feeding drive roller 20 and the pinch roller 21 which, at this time, is in its enabled state.

When the cut sheets are printed, the paper feeding ports A and B are utilized. The cut sheets are drawn by means of the drive roller 20 and the pinch roller 21 after they have been printed. In this state, the tractor unit T is positioned at the paper feeding position F, and the continuous paper is drawn to wait at the position in front of the platen 2.

A manner of feeding the continuous paper through the paper feeding port C will now be described.

As shown by a continuous line in FIG. 3, the tractor unit T positioned at the paper feeding position F is rotated inversely relative to the shaft 26 as shown by a long- and short-dash line in this figure so that the same is positioned at the drawing position E. The tractor unit T is thus set at the paper drawing position E. As described above, the pinch roller 21 is moved away from the drive roller 20 to its disenabled state in synchronization with the inverse movement of the tractor unit T.

The continuous paper which has been drawn through the paper feeding port C passes between the platen 2 and the printing head 3 and between the driving roller 20 and the pinch roller 21 which are disenabled and positioned away from each other so that it is set to the tractor unit T disposed at the paper drawing position E. The continuous paper is drawn by the tractor unit when printing begins.

Effect of the Invention

Since the device according to the present invention has the structure described above, the tractor unit can be used both for feeding to continuous paper and drawing paper. Furthermore, since the cut sheet and the continuous sheet can be set at one drawing position, the size of the printing device can be kept compact. Furthermore, when the cut sheet is printed, and a special device such as a page arranging mechanism is positioned at the drawing position, the tractor unit can be moved inversely from the paper drawing position to the paper feeding position, while when the continuous paper is drawn by means of the tractor unit, the pinch roller can be moved away from the drive roller for drawing paper. As a result of this, setting the continuous paper to the tractor unit can be facilitated.

What is claimed:

1. In a printing device having a platen and a print head disposed in opposed relation to one another to define a printing region through which continuous paper is selectively fed and drawn during use of the printing device; a paper tractor unit operable when in a feeding position to feed continuous paper to the printing region and operable when in a drawing position to draw continuous paper from the printing region; mounting means mounting the paper tractor unit for sliding movement to enable the paper tractor unit to accommodate continuous paper of different widths; supporting means displaceably supporting the mounting means for turning displacement between a first position to thereby shift the paper tractor unit to the feeding position and a second position to thereby shift the paper tractor unit to the drawing position; paper drawing means disposed downstream from the printing region and operable when enabled for drawing continuous paper fed by the paper tractor unit when the paper tractor unit is in the feeding position; and means for disenabling the paper drawing means in response to turning displacement of the supporting means from the first to the second position, said means being spaced from and out of contact with the supporting means when the supporting means is in the first position and being engageable with the supporting means during turning displacement thereof from the first to the second position to disenable the paper drawing means.

2. A printing device according to claim 1, wherein the supporting means comprises a support plate having the mounting means supported thereon, and means mounting the support plate for turning displacement.

3. A printing device according to claim 2; wherein the mounting means includes a pair of shafts slidably mounting thereon the paper tractor unit.

4. A printing device according to claim 3; wherein one of the shafts comprises a rotationally driven drive shaft, and means for transmittintg the rotational movement of the drive shaft to a drive belt of the paper tractor unit.

5. A printing device according to claim 1; wherein the supporting means includes means for turnably displacing the mounting means 180° between the first and second positions.

6. A printing device according to claim 1; wherein the paper drawing means includes a rotationally driven drive roller, and a pinch roller movable into engagement with the drive roller to define the enabled state of the paper drawing means and movable out of engagement with the drive roller in response to turning displacement of the supporting means to define the disenabled state of the paper drawing means.

7. A printing device according to claim 1; wherein the paper drawing means is positioned relative to the paper tractor unit such that the paper discharge path of continuous paper drawn by the paper drawing means when the paper tractor unit is in the feeding position is substantially the same as the paper discharge path of continuous paper drawn by the paper tractor unit when the paper tractor unit is in the drawing position.

* * * * *